US009180710B2

(12) United States Patent
Kobayashi et al.

(10) Patent No.: US 9,180,710 B2
(45) Date of Patent: Nov. 10, 2015

(54) PRINTING CONTROL APPARATUS AND PRINTING CONTROL METHOD

(71) Applicant: SEIKO EPSON CORPORATION, Tokyo (JP)

(72) Inventors: Takashi Kobayashi, Nagano (JP); Naoki Sudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/631,457

(22) Filed: Feb. 25, 2015

(65) Prior Publication Data

US 2015/0258828 A1 Sep. 17, 2015

(30) Foreign Application Priority Data

Mar. 12, 2014 (JP) ..... 2014-049494

(51) Int. Cl.
*B41J 2/205* (2006.01)
*B41J 29/38* (2006.01)

(52) U.S. Cl.
CPC ..... *B41J 29/38* (2013.01)

(58) Field of Classification Search
CPC ..... G06K 15/105; G06K 15/107
See application file for complete search history.

(56) References Cited

FOREIGN PATENT DOCUMENTS

EP 2272672 A1 * 12/2011 ..... B41J 2/01
JP 2006-326939 A 12/2006

* cited by examiner

*Primary Examiner* — Julian Huffman
(74) *Attorney, Agent, or Firm* — Global IP Counselors, LLP

(57) ABSTRACT

A printing control apparatus includes a split printing control section configured to split a region that is printable in one band into a plurality of regions according to a predetermined number of splits, and configured to carry out interlace printing in each of split regions on an outward path and a return path. The split printing control section is further configured to determine whether there is data where dots are applied in a region in a vicinity of a boundary of two of the split regions, which includes at least one of the two of the split regions that are adjacent to each other, based on printing data for each of the split regions, and configured to carry out printing by making the number of splits an odd number of times in a case where there is data where dots are applied.

8 Claims, 13 Drawing Sheets

( -6 ~ 6 )

( -12 ~ 18 )

( -22 ~ 18 )

( -22 ~ 18 )

( 0 ~ 12 )

PRINTING CONTROL APPARATUS AND PRINTING CONTROL METHOD

CROSS-REFERENCE TO RELATED APPLICATIONS

This application claims priority to Japanese Patent Application No. 2014-049494 filed on Mar. 12, 2014. The entire disclosure of Japanese Patent Application No. 2014-049494 is hereby incorporated herein by reference.

BACKGROUND

1. Technical Field

The present invention relates to a printing control apparatus and a printing control method where split printing is carried out with a width of one band.

2. Related Art

There is disclosed a technique for split printing where printing is carried out by a plurality of times of scanning (multipass scanning) irrespective of printing being theoretically possible in one pass. As disclosed in JP-A-2006-326939 (PTL 1), an amount of ink flow is reduced by increasing the number of passes in multipass scanning when the remaining amount of ink is less than a threshold.

SUMMARY

As disclosed in PTL 1, there is a possibility that the normal number of passes in multipass scanning will increase when the remaining amount of ink is low and that printing time for multipass printing with multipass scanning will increase more than necessary. In addition, a phenomenon such as Bi-d deviation occurs depending on the manner of splitting.

The present invention provides a printing control apparatus and a printing control method where a phenomenon such as Bi-d deviation (bi-directional printing deviation) does not occur even when split printing is carried out according to a dischargeable amount per unit of time.

The present invention is a printing control apparatus configured to use a recording head where a plurality of nozzles are arranged in a row formation with a predetermined pitch, and configured to perform interlace printing on an outward path and a return path such that a resolution is equal to or more than a resolution that is based on the pitch when printing is performed due to supplying of ink being received from an ink cartridge and ink droplets being discharged from each of the nozzles. The printing control apparatus includes a split printing control section configured to split a region that is printable in one band into a plurality of regions according to a predetermined number of splits, and configured to carry out the interlace printing in each of the split regions on the outward path and the return path. The split printing control section is further configured to determine whether there is data where dots are applied in a region in a vicinity of a boundary of two of the split regions, which includes at least one of the two of the split regions that are adjacent to each other, based on printing data for each of the split regions, and configured to carry out printing by making the number of splits an odd number of times in a case where there is data where dots are applied.

In this configuration, the recording head, where the plurality of nozzles are arranged in a row formation with the predetermined pitch, is used and interlace printing is performed on the outward path and the return path such that the resolution is equal to or more than the resolution based on the pitch. Printing is performed due to supplying of ink being performed from the ink cartridge to each of the nozzles and ink droplets being discharged from each of the nozzles.

In addition, upon determining the dischargeable amount per unit of time according to the remaining amount of ink in the ink cartridge, the split printing control section splits the predetermined region in one band an odd number of times according to the dischargeable amount per unit of time and carries out interlace printing in each of the split regions on the outward path and the return path.

In addition, the split printing control section splits a region that is printable in one band into a plurality of regions according to a predetermined number of splits and carries out interlace printing in each of the split regions on the outward path and the return path.

Ink droplets are discharged between the nozzles by printing on the outward path and the return path in theory in a case where interlace printing is carried out in each of the split regions on the outward path and the return path. However, printing in each of the split regions is carried out both either on the outward path or the return path when splitting the regions an even number of times. It is known that landing position deviations are generated on the outward path and the return path, and deviations stand out in a case where the regions which are printed only on the outward path and the regions which are printed only on the return path are alternately lined up with each other. Here, landing position deviations are not limited to being generated on the outward path and on the return path.

In contrast to this, deviations are prevented from standing out due to the regions which are printed only on the outward path and the regions which are printed only on the return path alternating with each other as if split an even number of times since printing is carried out while each of the split regions is filled in on the outward path and the return path when splitting the regions an odd number of times.

It takes time since printing is carried out with a margin of one pass when printing is carried out an odd number of times in order for deviations which are alternately lined up to not stand out. On the other hand, deviations do not stand out in a case where dots are not applied at positions which are close to the boundaries of the regions even if the regions which are printed only on the outward path and the regions which are printed only on the return path alternately line up.

For this reason, the split printing control section determines whether there is data where dots are applied in the region in the vicinity of the boundary of two of the split regions, which respectively include at least two of the split regions which are adjacent to each other, based on the printing data for each of the split regions since the deviations do not stand out in a case where dots are not applied at positions which are close to the boundary of the regions.

It is obvious that the number of times of splitting may be freely set to an odd number of times due to other conditions even though there is no data where dots which are applied at the region in the vicinity of the boundary described above. Setting the number of splits to an even number of times is avoided due to other conditions.

As one aspect of the present invention, the split printing control section may be configured to determine whether there is data where dots are applied for a region at an end of the recording head in a main scanning direction as the region in the vicinity of the boundary.

The recording head is moved back and forth on the outward path and the return path in the main scanning direction, and intervals immediately after starting driving and immediately before ending driving are referred to as an acceleration region and a deceleration region and are unstable periods where driving speed varies. Since it is particularly easy for landing position deviations to be generated on the outward path and on the return path during these intervals, it is easy for the deviations described above to stand out during interlace printing on only the outward path or on only the return path.

For this reason, the region, which is the region in the vicinity of the boundary, at the end of the recording head in the main scanning direction is the target when determining whether or not the number of times of splitting is to be an odd number of times. This is because it is difficult for deviations to stand out in other regions.

As one aspect of the present invention, the split printing control section is configured to determine whether there is data where dots are applied for pixel positions that line up in a sub-scanning direction in the region in the vicinity of the boundary.

Circumstances in which deviations are most remarkably generated are where dots are arranged to interpose the boundary, but whether or not there are circumstances where the dots are applied in the sub-scanning direction is a factor which has an effect. For example, it is difficult for deviations to stand out if dots are applied only in two pixels which interpose a boundary. In contrast to this, it is easy for deviations to stand out in circumstances where a straight line is drawn in the sub-scanning direction. For this reason, determination is implemented with whether deviations actually stand out being taken into consideration due to pixel positions, which line up in the sub-scanning direction, being the target when the region in the vicinity of the boundary is the determination target.

As one aspect of the present invention, the split printing control section is configured to determine whether there is data where dots are applied for a region that is surrounded by a plurality of pixels that line up in a main scanning direction and a sub-scanning direction in the region in the vicinity of the boundary.

There are often circumstances where deviations in landing positions of dots cannot be said to stand out in circumstances where two pixels line up. Accordingly, it is effective for circumstances where landing position deviations are included and a group of pixels are the target. For this reason, the region, which is surrounded by a plurality of pixels which line up in the main scanning direction and the sub-scanning direction, is the target.

As one aspect of the present invention, the split printing control section is configured to determine that there is data where dots are applied when a number of pixels for which there is data where dots are applied is a predetermined value or more in the region in the vicinity of the boundary. There is meaning in providing a certain threshold in order to sort out determining whether there is merit in taking time for an extra pass depending on the number of pixels even if deviations stand out. For this reason, time is taken for an extra pass only when the number of pixels, where there is data where dots are applied in the region in the vicinity of the boundary, is a predetermined number or more.

As one aspect of the present invention, the split printing control section is configured to determine that there is data where dots are applied when there is data of a ruled line along the region in the vicinity of the boundary.

There are many deviations and it is easy for the deviations to stand out since numerous dots are applied when there is a ruled line. For this reason, it is determined that there is data where dots are applied and the number of splits is set to an odd number of times when there is data of a ruled line along the region in the vicinity of the boundary.

As one aspect of the present invention, the split printing control section is configured to determine whether there is data where dots are applied for pixels in the region in the vicinity of the boundary by using filter calculation.

There are various methods for determining that there is data where dots are applied at a predetermined position. The region in the vicinity of the boundary is continuous in the width direction (main scanning direction) of the printing medium and it is complex to individually determine whether or not there is data where there dots are applied in the continuous region. In addition, it is preferable that it be possible to simultaneously perform determining of deviations which easily stand out and deviations which do not easily stand out. For this reason, pixel data in the region in the vicinity of the boundary is calculated using the filter calculation and it is determined whether there is data where dots are applied.

The technical concept according to the present invention is not limited to being realized only as an aspect of a printing control apparatus, and it is possible for this technical concept to be comprehended as, for example, an invention of a printing control method which has process steps which are executed by the printing control apparatus described above, an invention of a program where processes which are realized using the printing control apparatus described above are executed using hardware (a computer), or the like. In addition, the printing control apparatus may be realized by a single apparatus, may be realized as a system which consists of a plurality of apparatuses, or may be built into a certain product (for example, a printing apparatus).

According to the present invention, it is possible to provide a printing control apparatus and a printing control method where it is possible for landing position deviations to not stand out and for printing time to be shorter even when carrying out split printing.

BRIEF DESCRIPTION OF THE DRAWINGS

Referring now to the attached drawings which form a part of this original disclosure.

DETAILED DESCRIPTION OF EMBODIMENTS

An embodiment of the present invention will be described below based on the diagrams.

(1) Outline Explanation of Apparatus Configuration

Figure 1:
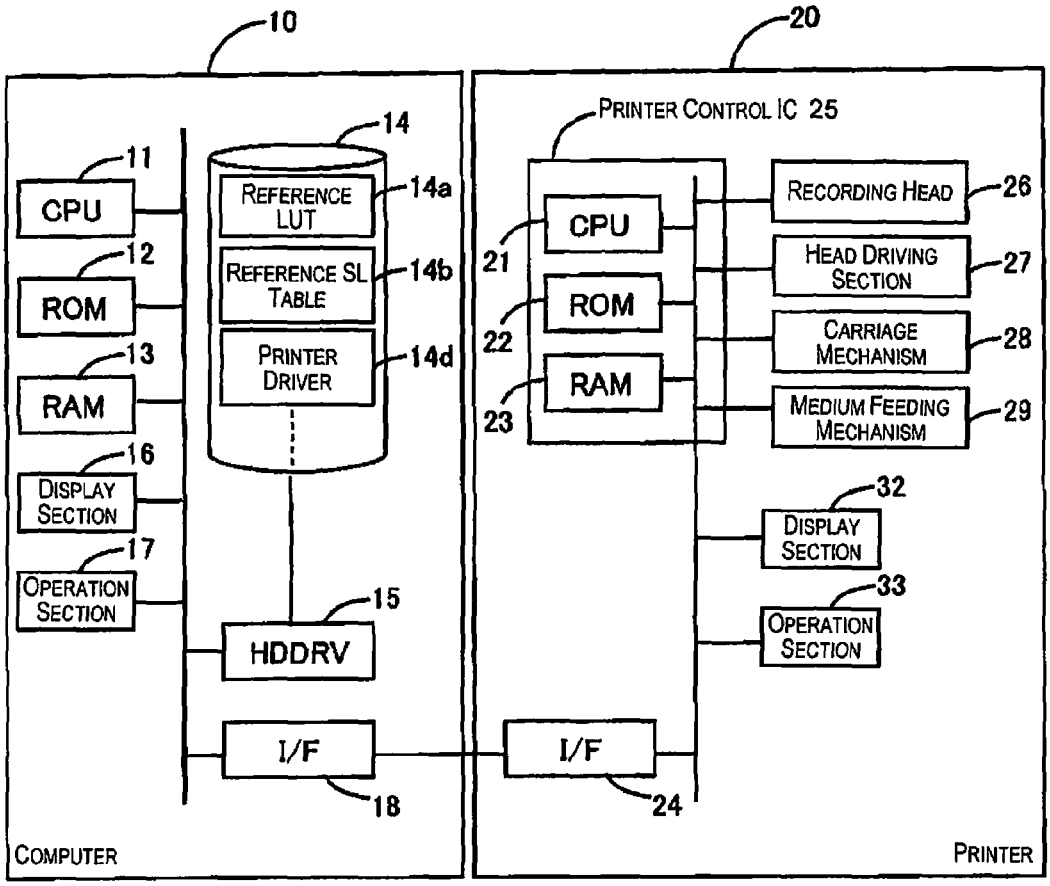
FIG. 1 is a block diagram illustrating a printing system where a printing control apparatus of the present invention is applied.

FIG. 1 illustrates a printing control apparatus according to an embodiment of the present invention using a block diagram.

The present system has, for example, a computer 10 and a printer 20. The computer 10 and/or the printer 20 are equivalent to an example of the printing control apparatus of the present invention. The printing control apparatus is the agent in executing a printing control method. In the computer 10, a CPU 11, which is the center for computation processing, controls the entirety of the computer 10 via a system bus. The bus is connected to a ROM 12, a RAM 13, and various types of interfaces (such as an I/F 18) and is also connected to a hard disk (HD) 14, which is a storage means, via a hard disk drive (HDDRV) 15. An operating system, an application program, a printer driver 14*d*, and the like are stored on the HD 14, and these are appropriately read out from the RAM 13 and executed using the CPU 11.

In addition, a reference LUT 14*a* which is a color conversion look up table (LUT) where color information in a predetermined output color system is associated with a plurality of grid points in a predetermined input color system, a reference SL table 14*b* which is a dot allocation table where gradation data which represents amounts of ink is converted into gradation data which represents amounts for forming a plurality of types of dots where the amounts of ink differ, and the like are stored on the HD 14. The printer driver 14*d*, the LUT, and table will be described later. Furthermore, the computer 10 is provided with a display section 16 which is configured using, for example, a liquid crystal display, an operation section 17 which is configured using, for example, a keyboard, a mouse, a touch pad, a touch panel, and the like.

The printer 20 is an example of a printing apparatus which is controlled by the computer 10. It is obvious that the printer 20 may be an apparatus which is able to realize printing processing by functioning autonomously without relying on controlling by the computer 10. In the printer 20, an I/F 24 is connected to an I/F 18 on the computer 10 side such that it is possible to communicate by wire or wirelessly, and a printer control IC 25 or the like is connected via a system bus. In the printer control IC 25, a CPU 21 appropriately reads out software (firmware) which is stored in a ROM 22 or the like from an RAM 23 and executes predetermined controlling. The printer control IC 25 is an IC which executes controlling mainly for printing processing and controls each section by being connected to each section of a recording head 26, a head driving section 27, a carriage mechanism 28, and a medium feeding mechanism 29. The recording head 26 will be described later.

The carriage mechanism 28 is a driving apparatus which is controlled by the printer control IC 25 and moves a carriage, which is not shown in the drawings, back and forth along a guide rail, which is not shown in the drawings, which is provided in the printer 20. The recording head 26 is mounted in the carriage and the recording head 26 discharges dots while being moved back and forth along the guide rail (main scanning). The medium feeding mechanism 29 transports a printing medium in the transport direction using a roller or the like, which is not shown in the diagrams, due to being controlled by the printer control IC 25. In addition, the printer 20 is provided with a display section 32 which is configured using, for example, a liquid crystal display and an operation section 33 which is configured using, for example, a button, a touch panel, and the like. Here, not just a device using an ink jet system but a device using a thermal system may also be adopted as the printer 20.

(2) Explanation of Recording Head

The recording head 26 receives a supply of each type of ink (for example, cyan (C) ink, magenta (M) ink, yellow (Y) ink, black (K) ink, light cyan (Lc) ink, and light magenta (Lm) ink) from ink cartridges with each type of the ink and forms an image on the printing medium by ejecting (discharging) ink droplets (dots) from a plurality of nozzles which are provided to correspond to each type of ink. The printer control IC 25 outputs applied voltage data, which corresponds to raster data which expresses an image which is a target for printing, with regard to the head driving section 27. The head driving section 27 generates and outputs an applied voltage patterns (driving waveforms) for piezoelectric elements, which are formed so as to correspond to each of the nozzles in the recording head 26, from the applied voltage data and discharges dots of each type of ink from each of the nozzles in the recording head 26. In the present embodiment, it is possible for the recording head 26 to discharge a plurality of types of dots, where the amount of ink per dot is different, from each of the nozzles. As an example, each of the nozzles discharges two types of dots where the amount of ink is different, and dots where the amount of ink is large are referred to as large dots and dots where the amount of ink is small are referred to as small dots. Printing, where a plurality of types of dots where the amount of ink is different are discharged in this manner, is referred to as multi-dot printing, but multi-dot printing is not necessarily essential to the present applied example.

Figure 2:
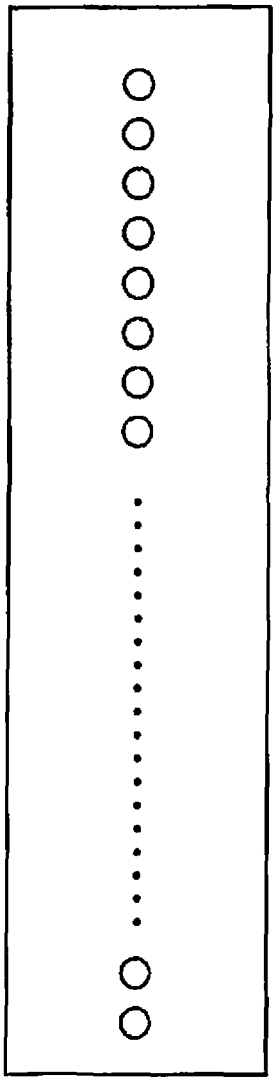
FIG. 2 is a bottom surface diagram illustrating nozzles in a row formation which are formed on a recording head.
Figure 3:
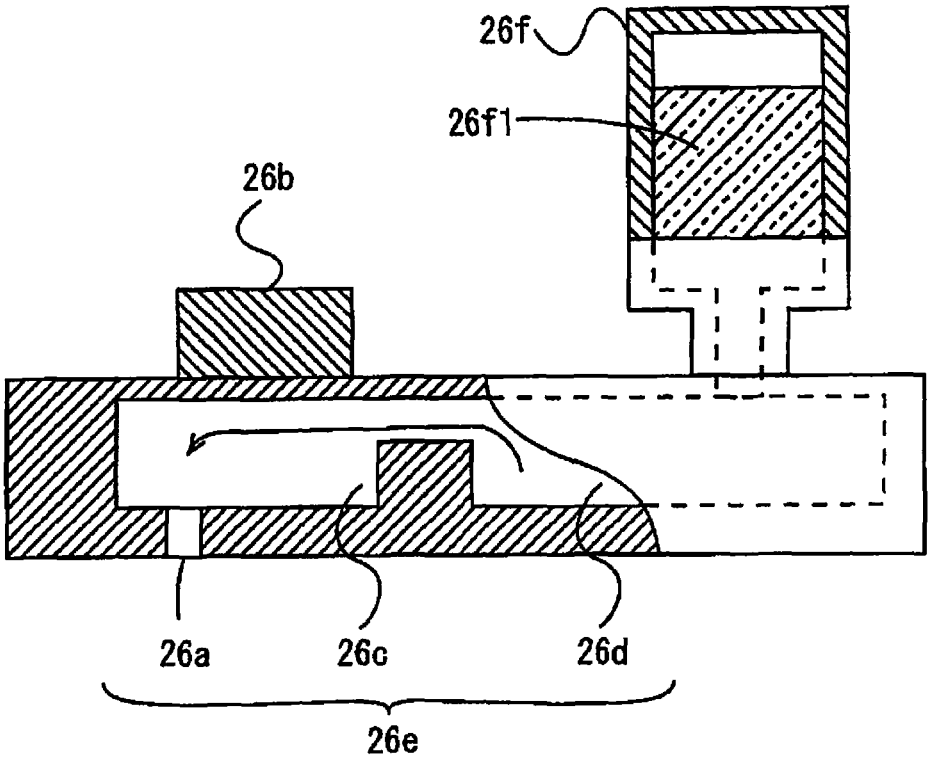
FIG. 3 is a schematic diagram which is a partial cross section of a recording head and an ink cartridge.

FIG. 2 illustrates nozzles in a row formation which are formed on the recording head using a bottom surface diagram, and FIG. 3 is a schematic diagram which is a partial cross section of the recording head and the ink cartridge.

Multiple nozzles 26*a* are formed on a bottom surface of the recording head 26 so as to be arranged at certain intervals (pitch) in one row. Here, the nozzles 26*a* may be in two rows instead of one row and may have a zig-zag shape instead of a straight line shape. In the recording head 26, an actuator 26*b* is arranged in each one of the nozzles 26*a*. In addition to the nozzle 26*a* which is a discharge opening, a reservoir 26*d* which is linked with an ink cartridge 26*f* is provided in a pressure chamber 26*c* which has a predetermined capacity. A path which reaches from the ink cartridge 26*f* to the nozzle 26*a* configures an ink flow path 26*e*. A sponge 26*f*1 is inserted into the ink cartridge 26*f* and liquid ink is absorbed and held. Here, it is possible for a plurality of types of materials to be used for the inner section of the sponge 26*f*1. The actuator 26*b* is formed using a piezoelectric element and ink droplets are discharged due to the capacity of the pressure chamber 26*c* being changed by the applied voltage pattern being individually applied.

(Remaining Amount of Ink and Duty Limit)

Figure 4:
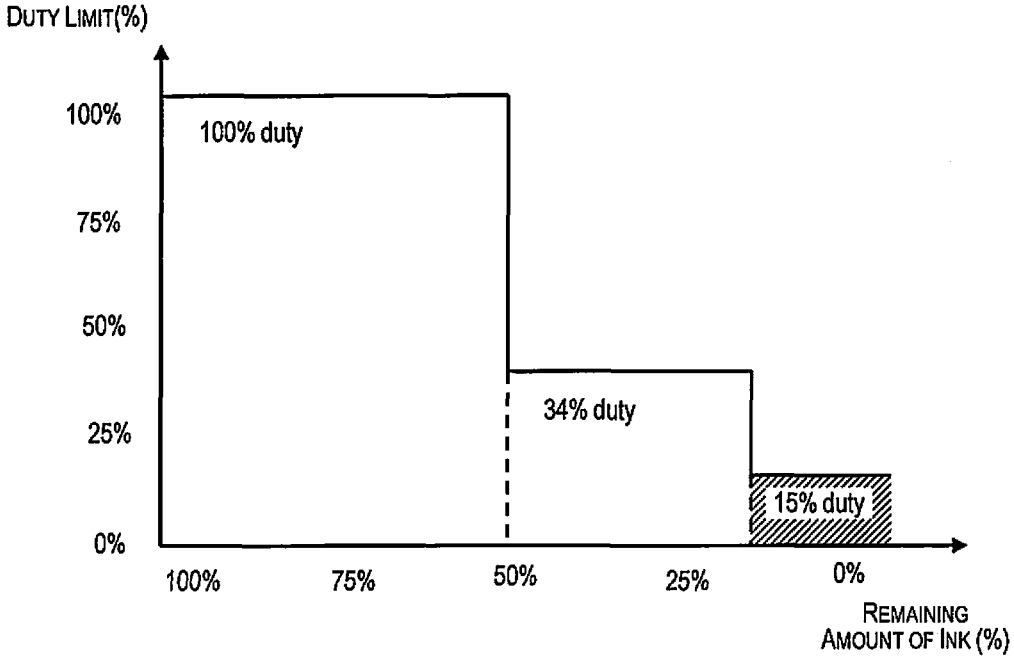
FIG. 4 is a diagram illustrating a relationship between a remaining amount of ink and a duty limit.

FIG. 4 illustrates a relationship between the remaining amount of ink and the duty limit using a graph. In FIG. 4, the remaining amount of ink is expressed on the horizontal axis and the duty limit is expressed on the vertical axis. The percentage value on the horizontal axis is 100% in a state where liquid ink is filled into the ink cartridge 26*f* so that the ink cartridge 26*f* is full. The percentage value on the vertical axis is 100% for the amount of discharge which is necessary when the recording head 26 discharges ink droplets from all of the nozzles 26*a* and how much ink is able to be supplied is represented as the dischargeable amount per unit of time or the duty limit. In other words, printing is not performed where the dischargeable amount per unit of time (the duty limit) is exceeded.

Sponge or foam is sealed in the ink cartridge 26*f* and the liquid ink is held by being impregnated into the sponge or foam. While there is merit in using the sponge, the limit for the amount of ink flow per unit of time is higher due to the sponge. Even in a case where there is the sponge, the maximum amount of ink which the recording head 26 is able to discharge per unit of time reaches 100% in a case where the remaining amount of ink is 50% or more. That is, the duty limit is 100% (where the limit is not actually reached). However, the duty limit is 34% when the remaining amount of ink drops below 50% and only 34% of the amount of ink which is necessary is able to be supplied during full usage. In addition, the duty limit is 15% when the remaining amount of ink drops below 12.5%, and only 15% of the amount of ink which is necessary is able to be supplied during full usage.

Printing of an amount which exceeds the duty limit is possible for a short period of time, but when using the ink in this manner, the amount of ink which is able to pass through the sponge is exceeded and a condition where ink runs out is apparent with regard to the ink which remains in the ink cartridge 26*f*.

(Duty Limit and Split Printing)

Figure 5A:
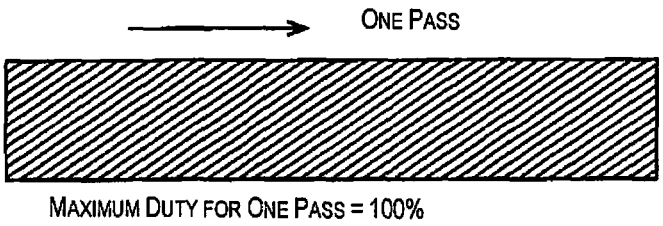
FIGS. 5A and 5B are diagrams illustrating duty limit and a concept of split printing.
Figure 5A:
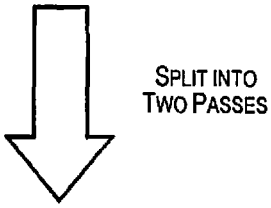
Figure 5B:
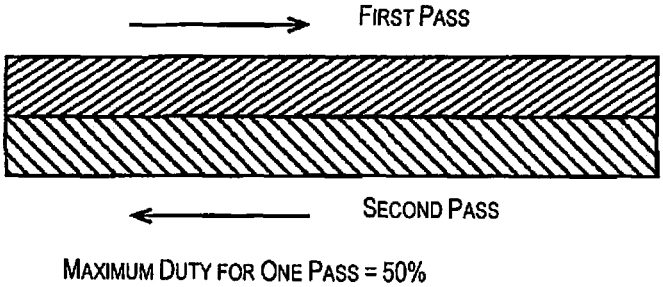

FIGS. 5A and 5B illustrate the duty limit and a concept of split printing using diagrams.

It is not possible to perform printing in full in a state where there is the duty limit, that is, a state where the duty limit is less than 100%. For this reason, printing on a region which is half of one band using only half of the nozzles 26*a* out of all of the nozzles 26*a* in a first pass which is on the outward path and printing on a region which is the remaining half of one band using only the remaining half of the nozzles 26*a* in a second pass which is on the return path as shown in FIG. 5B is used instead of where it is possible to print in one pass where all nozzles 26*a* of the recording head 26 are used as is the original manner as shown in FIG. 5A. Printing controlling in this manner is referred to as split printing or pass division.

The number of splits for split printing depends on the duty limit. The number of splits may be determined with an assumption that printing in full is based simply on the duty limit. For example, the number of splits is two if the duty limit is 99% to 50%, and the number of splits is three if the duty limit is 49% to 34%. In addition, the number of splits may be determined in consideration of the amount of discharge which is necessary for each one band.

(Interlace Printing and Split Printing)

Figure 6A:
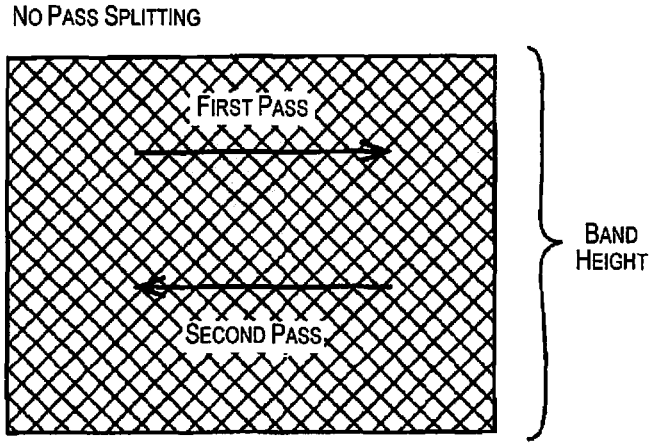
FIGS. 6A to 6C are diagrams illustrating an explanation for when interlace printing is carried out with split printing.
Figure 6B:
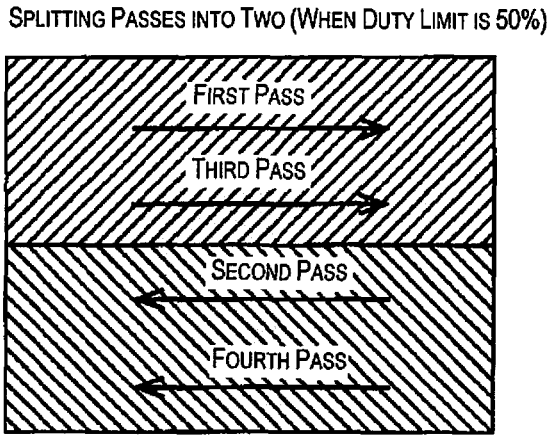
Figure 6C:
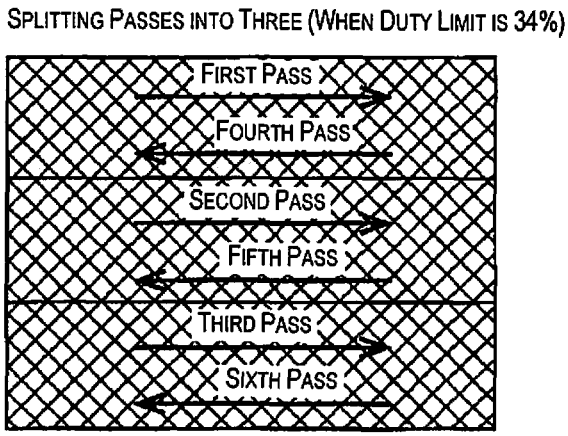

FIGS. 6A to 6C illustrate an explanation where interface printing is carried out with split printing using diagrams.

Interlace printing in the present invention is where the recording head 26, where the plurality of nozzles 26*a* are arranged in a row formation at a predetermined pitch, is used and printing is alternately performed on the outward path and the return path such that the resolution is equal to or more than the resolution which is based on the pitch when printing is performed due to supplying of ink being received from the ink cartridge 26*f* and ink droplets being discharged from each of the nozzles 26*a*. Here, the resolution is double the resolution which is based on the physical pitch between the nozzles 26*a* since the ink droplets for printing on the return path are positioned between the ink droplets which are printed on the outward path when the printing medium is sent by half of a pitch after printing on the outward path. The resolution is double in this example, but it is possible to obtain a resolution which is triple or more by increasing the number of passes.

In the interlace printing in FIG. 6A where split printing is not carried out, printing is carried out in regions with the height of one band (strictly, where half of a nozzle pitch is added) on the outward path (with the intention of an outward path part) and on the return path (with the intention of a return path part). On the return path, printing is carried out by sending the printing medium by half of a pitch such that dots are applied between the nozzles 26*a* which print on the outward path.

Split printing is possible even in the case of interlace printing, printing is carried out in the first pass which is over the outward path with the intention of the outward path part at the region which is the upper half part of the one band using only the nozzles 26*a* which are in the upper half part out of all of the nozzles 26*a*, printing is performed in the second pass which is over the return path at the region which is the lower half part which is the remainder of the one band with the intention of the outward path part using only the remaining nozzles 26*a* which are in the lower half part out of all of the nozzles 26*a*, and the printing medium is sent by half of a pitch as shown in FIG. 6B. Next, interlace printing is performed with the intention of the return path parts in a third pass and a fourth pass. Even in this case, interlace printing is performed in the third pass which is over the outward path at the region at the upper half part of the initial one band and printing is performed in the fourth pass which is over the return path at the region at the lower half part which is the remainder of the one band.

The ordering is as above (FIG. 6B) due to there being a restriction in that it is necessary for the printing medium to be sent by half of a pitch once printing on the outward path part is completed in interlace printing. In this case, printing is carried out on the outward path only in the upper half part of one band part and printing is carried out on the return path only in the lower half part of one band part.

On the other hand, in a case where the number of splits is three times, the printing medium is sent by half of a pitch after printing at the upper third on the outward path, the middle third on the return path, and the lower third on the outward path and interlace printing is carried out at each of the upper third on the return path, the middle third on the outward path, and the lower third on the return path as shown in FIG. 6C. As a result, interlace printing is carried out on the outward path and on the return path on all of the upper, middle, and lower regions.

That is, in circumstances where it is necessary to carry out split printing when carrying out interlace printing, printing is performed only on the outward path or only on the return path in each of the regions when splitting is carried out an even number of times, but it is understood that it is possible to perform interlace printing on the outward path and on the return path in all of the regions when splitting is carried out an odd number of times.

(Odd Number of Times Split Printing)

Figure 7A:
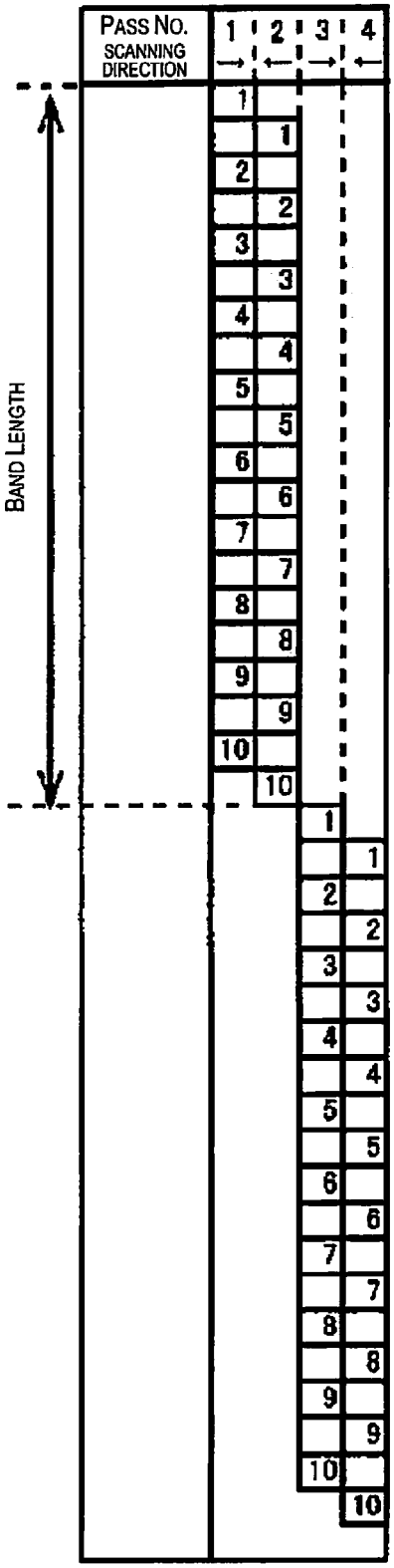
FIGS. 7A to 7C are diagrams illustrating pass division.
Figure 7B:
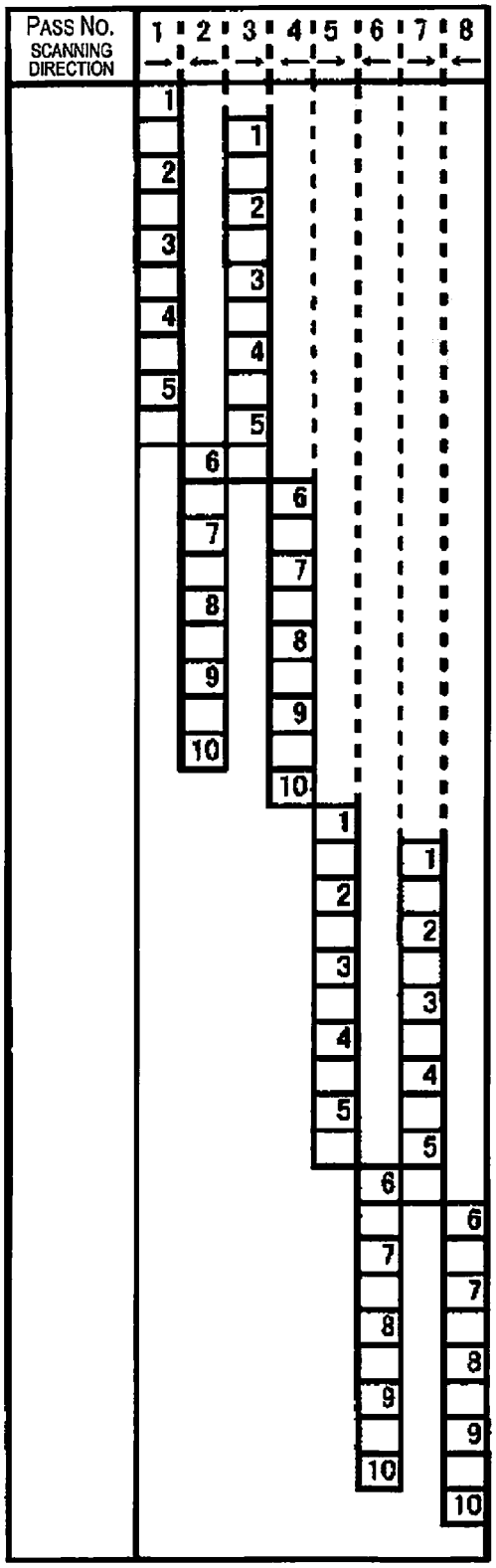
Figure 7C:
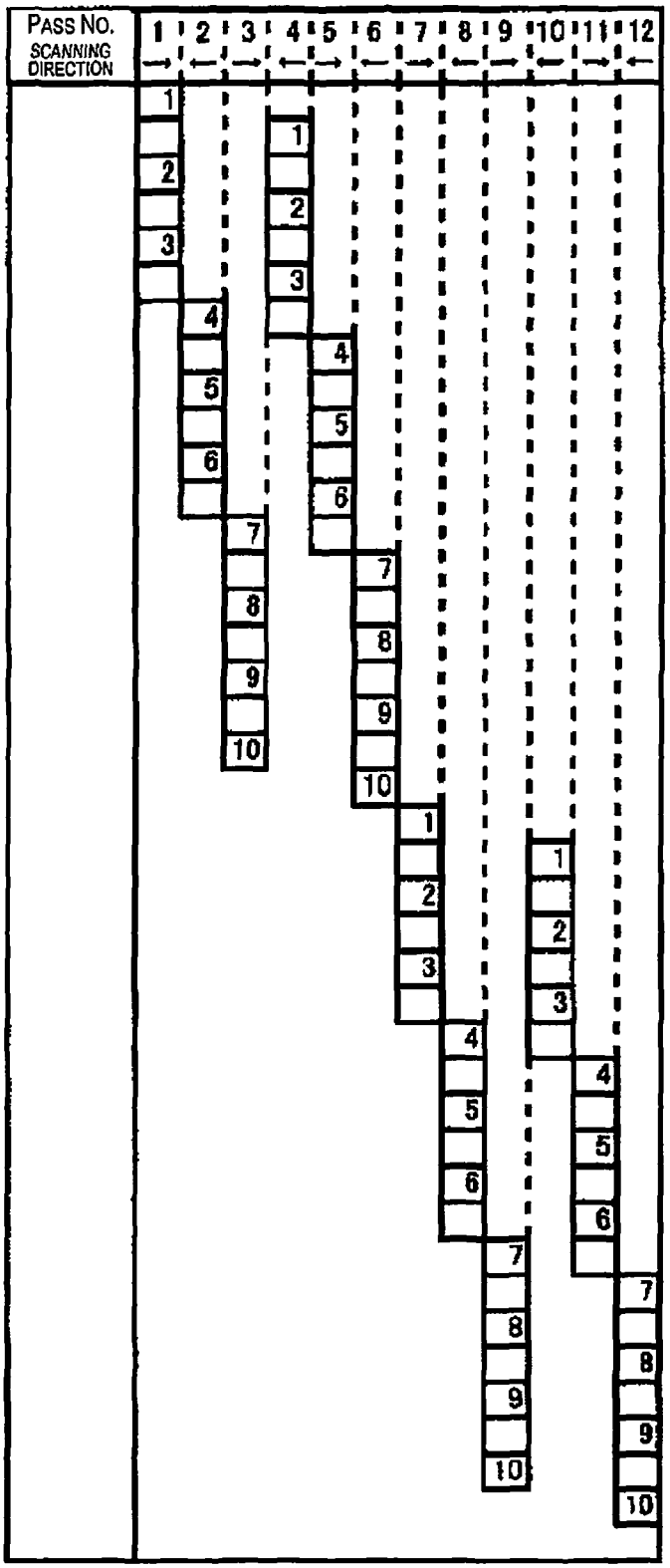

FIGS. 7A to 7C illustrate pass division. FIGS. 7A to 7C illustrate pass division in a process where printing is performed in two bands. FIG. 7A illustrates a case where split printing is not carried out, FIG. 7B illustrates a case where the number of splits is two times, and FIG. 7C illustrates a case where the number of splits is three times. The recording head 26 repeatedly prints on the outward path, the return path, the outward path, and so on when the number of the pass is 1, 2, 3, 4, and so on.

Figure 8A:
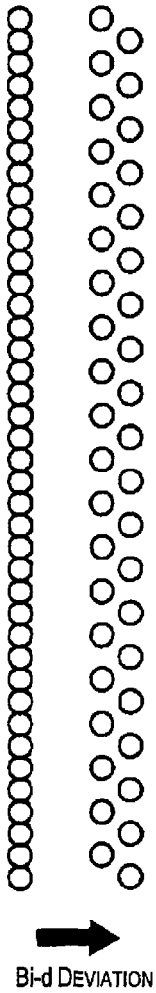
FIGS. 8A to 8C are diagrams illustrating Bi-d deviation.
Figure 8B:
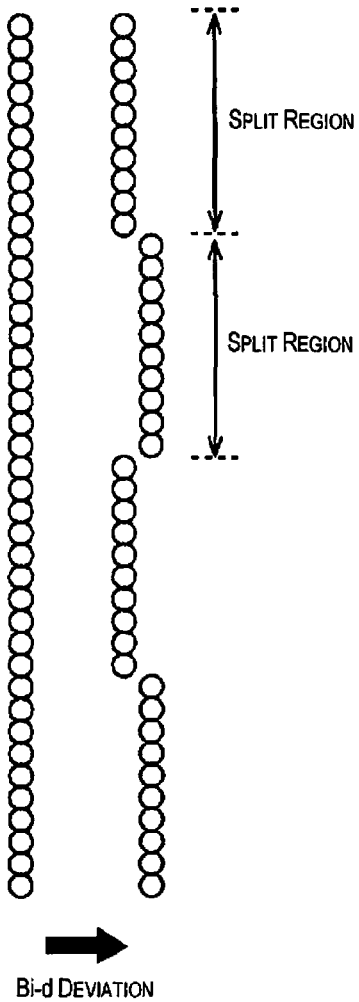
Figure 8C:
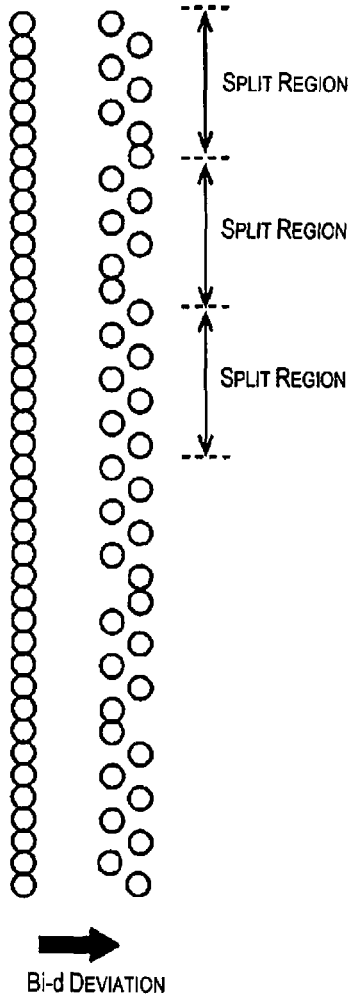

FIGS. 8A to 8C illustrate Bi-d deviation using diagrams. FIGS. 8A to 8C correspond to the pass division in FIGS. 7A to 7C. As shown in FIG. 8A, landing position deviations are generated on the outward path and on the return path as shown in the right column of FIG. 8A in a case where printing of one band is performed using one time of interlace printing. Landing position deviations are generated but it is often the case that there fortunately is an appearance of uniformity and it is not possible for the deviations to be visible since the deviations appear in all of the regions and there is also bleeding on the printing medium. In contrast to this, landing position deviations are generated only on the outward path or only on the return path in each of the regions which are split in interlace printing where the number of splits is two times (an even number of times) as shown in the right column of FIG. 8B. In this manner, the non-uniformity is visible as a consequence even if there is bleeding on the printing medium when the landing position deviations alternately appear in each of the regions. In contrast to this, printing in all of the regions which are split is necessarily carried out on the outward path and on the return path and uniformity is apparent over all of the regions even if landing position deviations are generated in each of the regions in interlace printing where the number of splits is three times (an odd number of times) as shown in the right column of FIG. 8C. By doing this, it is often the case that there fortunately is an appearance of uniformity and it is not possible for the deviations to be visible since there is also bleeding on the printing medium in the same manner as in the case of FIG. 8A.

(Image Quality Deterioration in Acceleration and Deceleration Regions)

When the carriage is moved back and forth, there are acceleration regions and deceleration regions at both ends of the guide rail and a central portion is a region where the speed is constant. It is known that landing position deviations are generated in the acceleration regions and the deceleration regions.

Figure 9A:
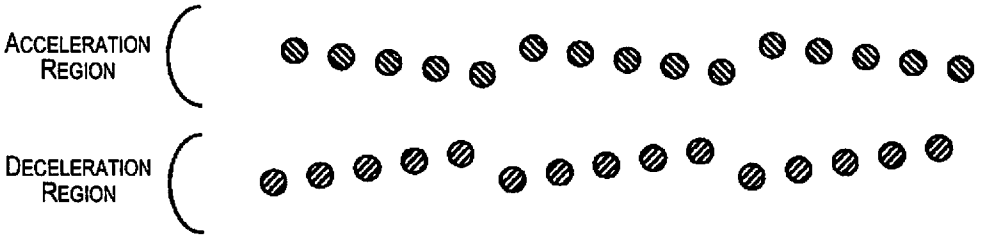
FIGS. 9A to 9C are diagrams illustrating dot adhering positions in acceleration and deceleration regions with odd number splitting and even number splitting.
Figure 9B:
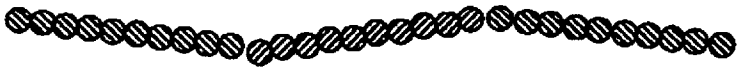
Figure 9C:
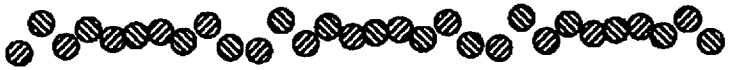

FIGS. 9A to 9C illustrate dot adhering positions in the acceleration and deceleration regions with odd number splitting and even number splitting using diagrams. FIG. 9A illustrates positional deviations in the acceleration regions and the deceleration regions, FIG. 9B illustrates a case where there is an even number of splits, and FIG. 9C illustrates a case where there is an odd number of splits. In a case where split printing is carried out, a region, where printing is carried out in one pass, is reduced in theory. However, five dots are respectively drawn in all cases in FIGS. 9A to 9C so as to be equivalent to printing one pass in order for the tendency to image deterioration in the acceleration and deceleration regions to be easy to understand.

In interlace printing, it is difficult for image deterioration to stand out in the acceleration and deceleration regions in a case where split printing is not carried out since the dots which are printed in the deceleration regions are interposed between the dots which are printed in the acceleration regions. The same effects occur in the case of Bi-d printing.

However, image deterioration stands out when split printing is carried out in a case where an even number of splits is carried out since the dots which are printed in the acceleration regions are interposed between the dots which are printed in the acceleration regions and the dots which are printed in the deceleration regions are interposed between the dots which are printed in the deceleration regions and this is repeated in every region in FIG. 9B. However, it is difficult for image deterioration to stand out when split printing is carried out in a case where an odd number of splits is carried out since the dots which are printed in the deceleration regions are interposed between the dots which are printed in the acceleration regions in FIG. 9C in the same manner as the case where split printing is not carried out.

(Explanation of Printing Control)

Figure 10:
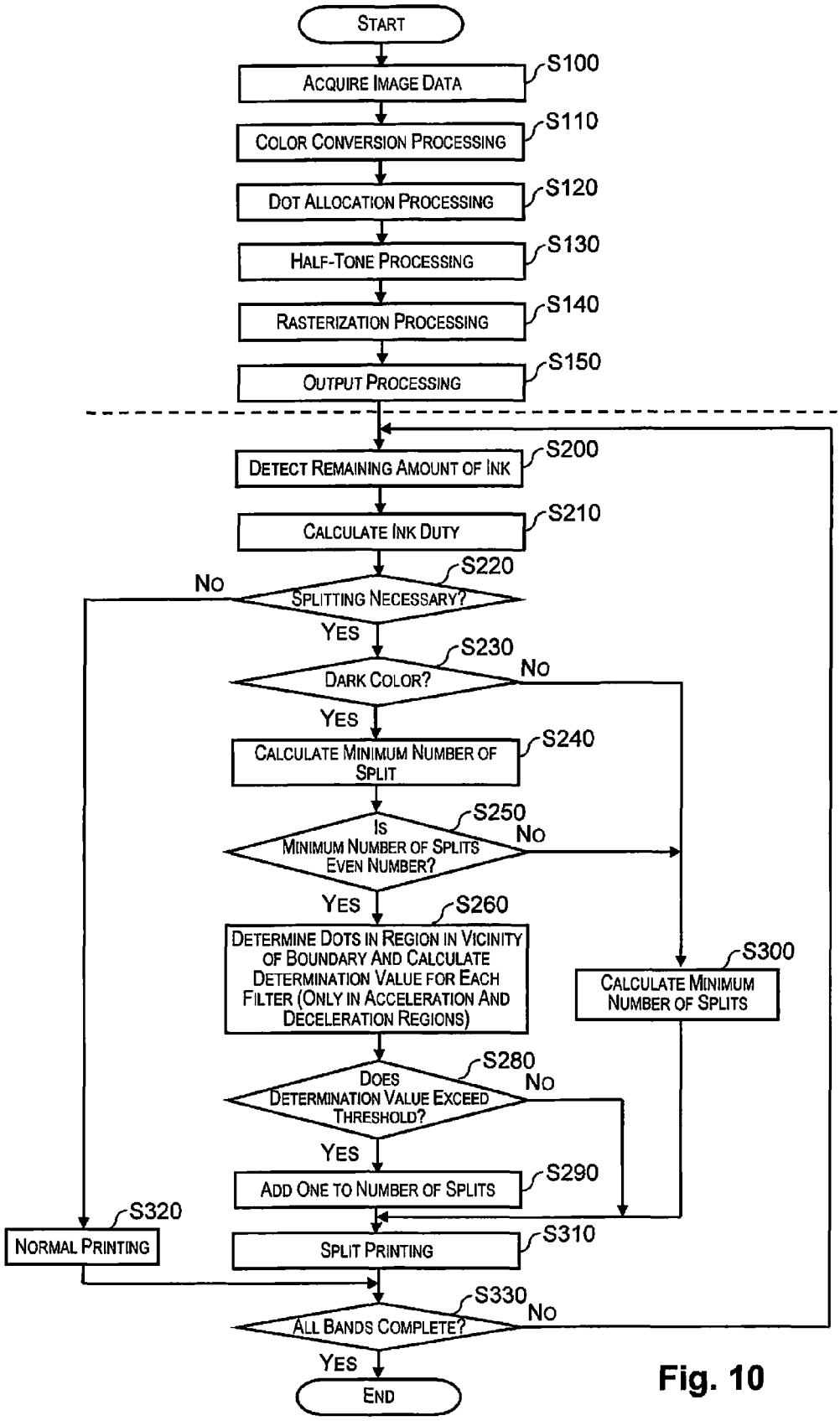
FIG. 10 is a flow chart illustrating printing controlling which is implemented by a printing control apparatus.

FIG. 10 illustrates printing control which is executed by the printing control apparatus using a flow chart.

In step S100, the CPU 11 reads out and acquires image data or the like, which is selected by a user as the target for printing, from a predetermined memory region such as the HD 14. It is possible for a user to arbitrarily select the image data which is the target for printing by operating the operation section 17 while a predetermined UI screen, which is displayed on the display section 16, is visible. Here, it is possible for the CPU 11 to appropriately execute resolution conversion processing, image quality correction processing, and the like with regard to the image data.

In step S110, the CPU 11 carries out color conversion on the image data which is the target for printing with reference to a color conversion LUT. As a result, the image data, which has a setting for an amount of CMYKLcLm ink, is generated for each pixel. In step S120, the CPU 11 converts (carries out dot allocation processing on) each amount of ink (gradation value), which configures the settings for the amounts of ink for each pixel in the image data, to the amount for forming for small and large dots (gradation values) with reference to the dot allocation table.

In step S130, the CPU 11 executes so-called half-tone processing with the image data after dot allocation processing as the target. In the half-tone processing, a well-known method such as a dither method or an error diffusion method is used, and half-tone data, where at least one out of non-discharge of dots, small dot discharge, or large dot discharge is specified, is generated for each pixel which configures the image data and each type of ink. Here, multi-dot printing is not essential. In step S140, the CPU 11 carries out predetermined rasterization processing with regard to half-tone data and generates raster data for each type of ink where data is sorted in the order in which the recording head 26 discharges ink. In step S150, the CPU 11 outputs a printing command, which includes raster data, to the printer 20 via the I/F 18. The printer 20 implements the processing of step S200 and beyond after the processing as above on the computer 10 side is complete.

In step S200, the CPU 21 on the printer side detects the remaining amount of ink. Normally, the printer 20 counts the number of shots (the number of times (and the size if necessary) with which ink droplets are discharged) since replacing of the ink cartridge 26*f* and manages the remaining amount of ink by calculating the amount of ink which is used from the number of shots. For this reason, it is sufficient if the processing, where the remaining amount of ink is detected, is simply read out from a separate non-volatile memory region in step S200. Here, if a remaining amount sensor is provided in the ink cartridge 26*f*, it is sufficient if a detection value from the remaining amount sensor is used as the remaining amount of ink. A correspondence relationship between the remaining amount of ink and the duty limit (the dischargeable amount per unit of time) is determined in advance and is stored in a table or the like. Accordingly, the duty limit is also understood when the remaining amount of ink is determined. Accordingly, the processing in step S200 configures a dischargeable amount acquiring means (step).

Next, in step S210, the CPU 21 computes the ink duty (IkD). Here, the ink duty represents the amount of ink discharge which is necessary for so-called printing of one band by referencing the raster data. The ink duty is the amount of ink discharge which is necessary for one band part of interlace printing on the outward path and the return path where all of the nozzles 26*a* of the recording head 26 are used based on the raster data. The ink duty is the total amount for small dots and large dots when carrying out multi-dot printing. In addition, the total amount of each type of ink is determined for all of the ink.

In step S220, the CPU 21 determines whether split printing is necessary using the ink duty which is determined in the manner described above and the duty limit which corresponds to the remaining amount of ink. Split printing is necessary if the current amount of ink discharge is not able to be supplied within the duty limit. For example, there is a high possibility that split printing is necessary if printing of a solid region is necessary in a state where the duty limit is being applied. It is reasonable that it may be determined that split printing is necessary without the amount of ink discharge which is necessary being determined in step S210 if the number of splits is simply determined based only on the duty limit as described above.

Next, in step S230, the CPU 21 determines whether or not ink which is necessary for split printing is a dark color. Determining of whether the ink is a dark color is carried out because it is irrelevant if the number of splits to an even number of splits with the light color as described above since it is barely possible for even slight positional deviations to be visible with a bright light color such as yellow. It is also possible to add light cyan or light magenta as the bright light colors. Here, it is sufficient if the bright light colors are determined by examining each color.

In step S240, a minimum number of splits is determined in a case where the color is a dark color. With IkS as the amount of discharge which is the duty limit which corresponds to the remaining amount of ink and IkD as the ink duty which is determined in step S210, the minimum value of a number of splits Nd is determined by rounding up (IkD/IkS).

If it is assumed IkD=50 and IkS=100, IkD/IkS=0.5, and this value is rounded up to one time and becomes the minimum value for the number of splits Nd. In this case, split printing is not necessary.

Next, if it is assumed IkD=50 and IkS=34, IkD/IkS=1.47, and this value is rounded up to two times and becomes the minimum value for the number of splits Nd.

Next, if it is assumed IkD=50 and IkS=15, IkD/IkS=3.33, and this value is rounded up to four times and becomes the minimum value of the number of splits Nd.

Next, the CPU 21 determines whether the minimum number of splits is an even number in step S250. As described above, there are cases where Bi-d deviation and landing position deviations in the acceleration and deceleration regions stand out in interlace printing with an even number of splits.

However, there are cases where landing position deviations do not stand out due to arranging of the dots in the region in the vicinity of the boundary of the split regions even with an even number of splits. In step S260, the CPU 21 performs determining of dots in the region in the vicinity of the boundary using filter calculation. In detail, filter calculation is performed with the pixel data of the region in the vicinity of the boundary as the target.

FIGS. 11A to 11E illustrate correspondence between a filter and a pattern where dots are applied in a region in the vicinity of the boundary of two split regions which respectively include at least two of the split regions which are adjacent to each other using diagrams.

Figure 11A:
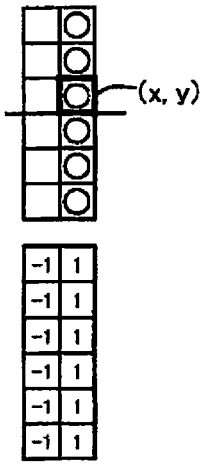
FIGS. 11A to 11E are diagrams illustrating correspondence between a filter and a pattern where dots are applied in a region in the vicinity of a boundary of two split regions which respectively include at least two split regions which are adjacent to each other.
Figure 11B:
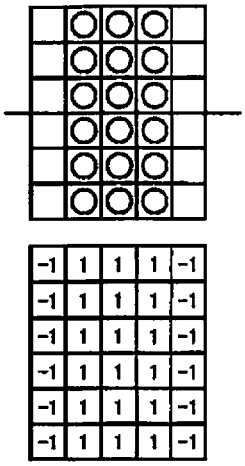

FIG. 11A is an example of a pattern (arrangement) where dots are arranged at the region in the vicinity of the boundary of two split regions which respectively include at least two of the split regions which are adjacent to each other and is an example of where landing position deviations described above stand out when dots line up in this manner. A dot pattern is shown in the upper level of FIG. 11A and an example of a filter which is useful in detecting is shown in the lower level of FIG. 11A. Printing data which is input as raster data is binary data which represents positions where dots are applied and positions where dots are not applied. In a case of multiple dots, it is preferable to convert the printing data to binary data since it is necessary to determine whether or not dots are applied even if the dots are small dots or large dots.

The filter, which is shown in the lower level of FIG. 11A, is multiplied with binary data as an assumption. With pixels with the coordinates of (x, y) as target pixels in FIG. 11A, the value of each square in the filter which is in the lower level of FIG. 11A is individually multiplied with regard to binary data of the pixel position in the frame which is shown in the drawing and the respective products are integrated. By doing this, the integrated value has a maximum value of "6" in a case where the dot pattern completely matches the pixels in the upper level of FIG. 11A, and the integrated value has a minimum value of "−6" in the reverse case where ON and OFF of the dots are completely opposite to the dot pattern. The integrated value is also referred to as a determination value since it is possible to determine whether or not the dot pattern matches what is estimated using the integrated value. It is possible to determine that the binary printing data completely matches the pixels through the maximum value and it is possible to determine that the binary printing data is the complete reverse of the pixels through the minimum value if a filter with a factor of "+1" or "−1" is calculated.

Patterns where landing position deviations stand out due to split printing with an even number of splits are where a) dots which span across the boundary are continuous (in the sub-scanning direction), b) a number of dots are continuous along the boundary (in the main scanning direction), and c) dots are cut off at the boundary but are continuous before and after the boundary (in the sub-scanning direction). The conditions in a) correspond to a solid line being formed continuously in the sub-scanning direction, the conditions in b) correspond to it being difficult for fine lines which are only one pixel to stand out, and the conditions in c) correspond to a case where a broken line is drawn.

The conditions of a) are equivalent to determining whether there is data where dots are applied with pixel positions which line up in the sub-scanning direction as a target. In addition, the conditions of b) are equivalent to "determining whether there is data where dots are applied with pixel positions which line up in the main scanning direction as a target". The conditions which are included in both a) and b) are equivalent to "determining whether there is data where dots are applied with a region, which is surrounded by a plurality of pixels which line up in the main scanning direction and the sub-scanning direction, as a target".

Figure 11C:
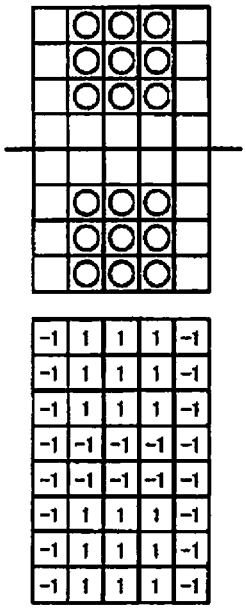
Figure 11D:
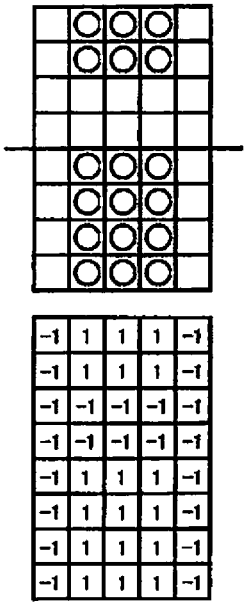

In the examples of the filters shown in FIGS. 11A to 11E, FIG. 11B provides a typical example of a) and an element of b). FIG. 11C and FIG. 11D provide an example of c) and also an element of b). These filters are prepared by taking into consideration that it is easy for landing position deviations to stand out with ruled lines and characters which are continuous in the sub-scanning direction. In addition, detection of so-called ruled lines is effective since it is possible to the example of the filter in FIG. 11E to detect lining up of the dots which are continuous along the boundary. Calculation results using each of the filters are "−12 to 18" in FIG. 11B, "−22 to 18" in FIG. 11C, "−22 to 18" in FIG. 11D, and "0 to 12" in FIG. 11E.

Figure 11E:
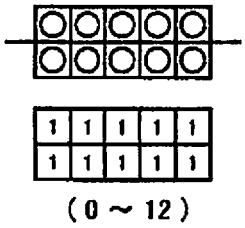

By using the filters in FIG. 11E, it is possible to determine that "there is data where dots are applied when there is data of a ruled line along the region in the vicinity of the boundary".

Here, this is only one example and it is obviously possible to take other conditions into consideration. In addition, the examples in FIG. 11B to FIG. 11D correspond to dots with three pixels in the main scanning direction, but three pixels are merely an example in order for ease of understanding. Three pixels is equivalent to a fine line of 0.2 mm since each dot is approximately 0.07 mm in a case where the dot density is 360 dpi. Accordingly, approximately seven dots are used for thicker ruled lines with the width of the ruled line being, for example, 0.5 mm. On the other hand, a ruled line of 1 mm has 50 dots, and it can be said that it is difficult for landing position deviations of one dot to be generated at both ends of the 50 dots. Accordingly, the design of the filter is determined by taking into consideration the circumstances of how easy it is for landing position deviations to stand out.

Next, the range over which the filter calculation described above is implemented will be described.

Figure 12:
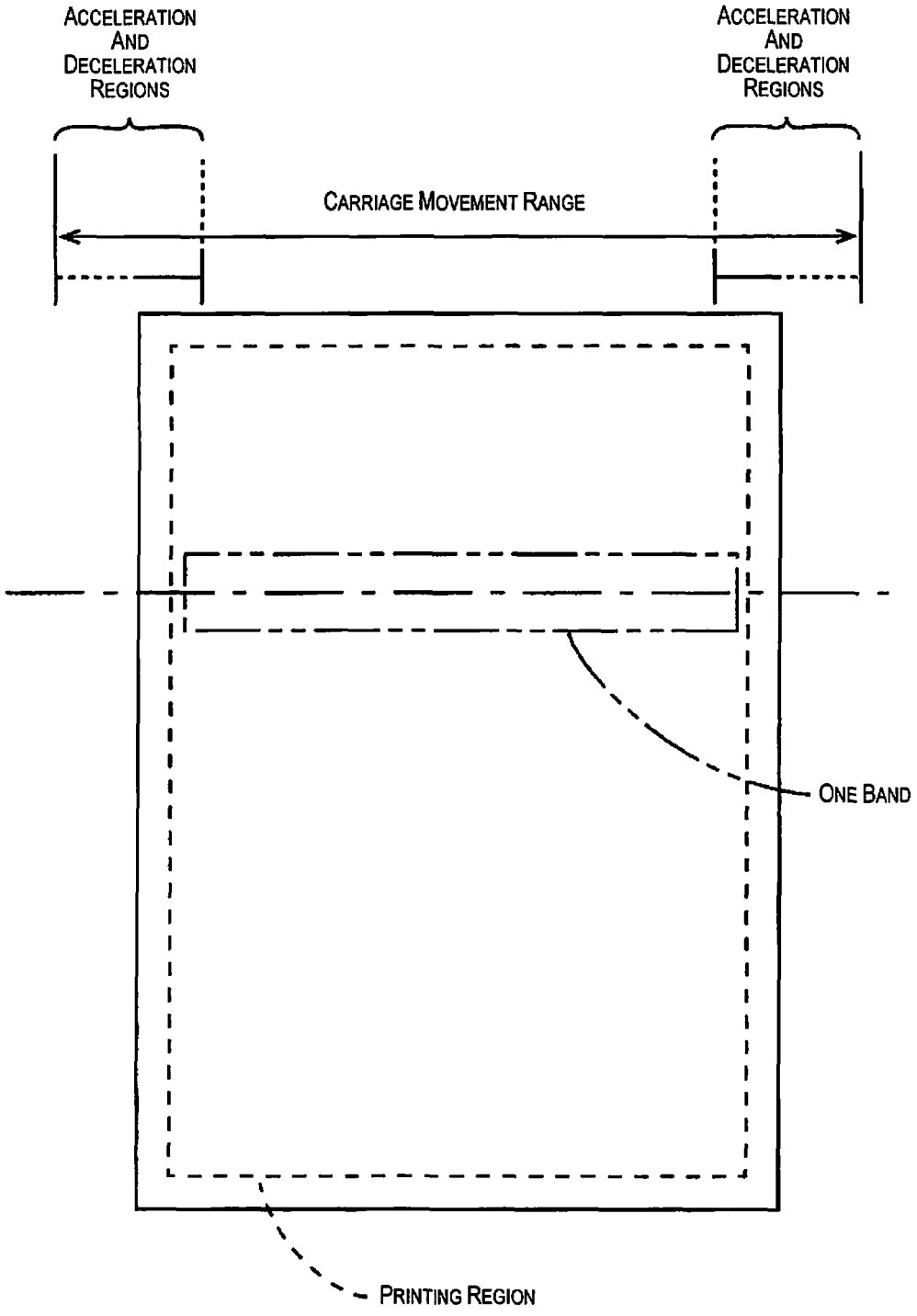
FIG. 12 is a diagram illustrating a printing medium, a printing region, and acceleration and deceleration regions.

FIG. 12 illustrates a printing medium, a printing region, and acceleration and deceleration regions using a diagram.

As shown in FIG. 12, it is possible to move the recording head 26 back and forth over the movement range of the carriage, and the recording head 26 is moved back and forth above the printing region of the printing medium. Here, the recording head 26 is moved back and forth over a range so as to interpose the printing region if the printing region is a portion of the printing medium. The carriage is driven from the outer side of the printing region along with the printing head 26 and is moved to the opposite side which interposes the printing region. At this time, the regions immediately after driving is started and immediately before driving is stopped are referred to as acceleration and deceleration regions, and the region between the acceleration and deceleration regions is referred to as a constant speed region. It is easy for landing position deviations to be generated in the acceleration and deceleration regions since speed is not constant. On the other hand, it is easy for Bi-d deviations to be generated over the entire width of the printing region.

For this reason, if the filter calculation, which is implemented in step S260, is carried out over the entire width of the printing region, it is possible to prevent the effects of Bi-d deviations and it is possible to prevent the effects of landing position deviations in the acceleration and deceleration regions even if the filter calculation is implemented only in the acceleration and deceleration regions. Here, the filter calculation being implemented only in the acceleration and deceleration regions is equivalent to "determining whether there is data where dots are applied in regions at the ends of the recording head in the main scanning direction". Here, it is not always necessary to perform filter calculation at both ends.

In step S260, it is determined whether filter calculation is implemented over the entire width of the printing region or whether filter calculation is implemented only in the acceleration and deceleration regions. The CPU 21 implements filter calculation with regard to pixel rows at the boundary of the split regions in the range which is determined and a determination value for each filter, which is a calculation result, is stored so as to be associated with each pixel.

In step S280, the CPU 21 determines whether the determination value exceeds a threshold. The calculation result, where the filter calculation is implemented with regard to the pixel rows at the boundary of the split regions in the range which is determined, is stored and the value is compared to the threshold. The filters in FIG. 11B to FIG. 11D have a common maximum value of "18" and it is possible to determine that the pixels in the vicinity of the target pixels have a dot pattern where it is easy for landing position deviations to stand out if the calculation result (the determination result) which is stored is "18" (if it is determined that the threshold is exceeded when the threshold is 17). This determination is performed for each of the filters. Determining that the determination value exceeds the threshold for any of the filters is equivalent to determining that "there is data where dots are applied in the region which is in the vicinity of the boundary of two of the split regions which respectively include at least two of the split regions which are adjacent to each other based on printing data in each of the split regions".

In a case where it is determined that this is the case, the CPU 21 increases the number of splits by one (+1) in step S290 so that the number of splits is an odd number of times. The number of splits is an odd number of times since one is added to an even number of times. There is no printing with interlace printing with an even number of times at a boundary, where landing position deviations which easily stand out are included, due to the number of splits being an odd number of times. In addition, even without changing the number of splits from an even number of splits, it is not a problem if interlace printing is implemented with an even number of splits in a case where No is determined in step S280 since it is not the circumstances where landing position deviations stand out in the vicinity of the boundary.

Here, if the determination that the number of splits is to be an odd number of times is established at one location over the entire width, an odd number of times may be used, but the number of splits which is determined in this manner may also be taken into consideration. That is, it is effective if "the number of pixels where there is data where dots are applied in the region which is in the vicinity of the boundary" is counted and there is determining such that "it is determined that there is data where dots are applied when the number of these pixels is a predetermined value or more". In other words, one or two locations can be ignored even when there are landing position deviations which stand out and the number of splits is changed from an even number of times to an odd number of times when there are several locations.

Here, it is not also necessary to implement the filter calculation or the like at a new boundary since the problem of landing position deviations is completely eliminated due to the number of splits being an odd number of times even though the split regions change due to the number of splits being modified from an even number of times to an odd number of times and the boundary is also changed.

As above, it is possible to minimize the opportunities for increases in the number of splits and to also maintain printing quality with no printing only on the outward path or only on the return path with landing position deviations standing out due to the number of splits being an odd number of times only in necessary cases by determining whether there is a dot pattern where landing position deviations actually stand out even if the minimum number of splits is an even number of times in a case where split printing is necessary due to the duty limit which is associated with the remaining amount of ink.

On the other hand, the CPU 21 determines the number of splits without being limited to an odd number of times in step S300 in a case where it is determined that splitting is necessary in step S220 and it is determined that the color is not a dark color in step S230.

Once the number of splits is determined, the CPU 21 performs split printing by dividing by the width of one band into regions depending on the number of splits in step S310. Here, printing (that is, interlace printing), where all of the nozzles 26*a* are used without splitting, is performed in step S320 in a case where split printing is not necessary.

Since the processing described above is processing carried out in band units, the CPU 21 determines whether the processing described above is complete for all of the bands in step S330 and the processing described above continues while there are bands which have not been processed. Here, the processing of step S200 to step S310 configures the split printing control means (process).

(Split Printing Using Limit on Power Consumption)

A limit on power consumption is one example of a reason where split printing is effective. Power consumption is related to the number of nozzles since it is necessary to supply power to each of the nozzles 26*a* in discharging of ink droplets. It is possible to reduce the number of the nozzles 26*a* which are used and to reduce power consumption by carrying out split printing in a case where the limit on power consumption is exceeded when all of the nozzles 26*a* are used in one band.

According to the present invention, it is possible to prevent the adverse effects described above which are generated at the boundary of the split regions in such cases.

(Split Printing Using Limit on Ink Duty for Printing Medium)

An amount of ink which is able to be adsorbed per unit of time per unit area and the limit on ink duty are known to depend on the printing medium. When a large amount of liquid is absorbed in a short period of time, there are adverse effects such as warping of the printing medium. Although the extent of this differs according to the printing medium, it is necessary to print without exceeding the limit on ink duty (the maximum value of the amount of ink which it is able to be adsorbed per unit of time per unit area in order for there to be none of the adverse effects described above) which is associated with the printing medium which is specified at the printer 20 side during printing. In this case, split printing is effective. It is possible to secure a period of time for drying due to the time difference from the amount of discharge which is to be theoretically printed in one pass being discharged onto the printing medium by carrying out split printing and splitting in two passes or three passes and it is possible to mitigate the limit on the amount of discharge per unit of time.

According to the present invention, it is possible to prevent the adverse effects described above which are generated at the boundary of the split regions in such cases.

Here, it is obvious that the present invention is not limited to the applied examples. It would be obvious to a person skilled in the art that:

applying appropriate modifications to the combinations of members, configurations, and the like which are disclosed in the applied examples and which are able to be mutually interchanged, applying appropriate interchanging and modifications to the combinations of members, configurations, and the like which are able to be mutually interchanged with members, configurations, and the like, which are known techniques and which are disclosed in the applied examples even though these are not disclosed in the applied examples, applying appropriate interchanging and modifications to the combinations of members, configurations, and the like which are able to be assumed as substitutes for members, configurations, and the like which are disclosed in the applied examples to a person skilled in the art based on known techniques and the like even though these are not disclosed in the applied examples, are disclosed as applied examples of the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A printing control apparatus configured to use a recording head where a plurality of nozzles are arranged in a row formation with a predetermined pitch, and configured to perform interlace printing on an outward path and a return path such that a resolution is equal to or more than a resolution that is based on the pitch when printing is performed due to supplying of ink being received from an ink cartridge and ink droplets being discharged from each of the nozzles, the printing control apparatus comprising:

a split printing control section configured to split a region that is printable in one band into a plurality of regions according to a predetermined number of splits, and configured to carry out the interlace printing in each of split regions on the outward path and the return path, the split printing control section being further configured to determine whether there is data where dots are applied in a region in a vicinity of a boundary of two of the split regions, which includes at least one of the two of the split regions that are adjacent to each other, based on printing data for each of the split regions, and configured to carry out printing by making the number of splits an odd number of times in a case where there is data where dots are applied.

2. The printing control apparatus according to claim 1, wherein the split printing control section is configured to determine whether there is data where dots are applied for a region at an end of the recording head in a main scanning direction as the region in the vicinity of the boundary.

3. The printing control apparatus according to claim 1, wherein the split printing control section is configured to determine whether there is data where dots are applied for pixel positions that line up in a sub-scanning direction in the region in the vicinity of the boundary.

4. The printing control apparatus according to claim 1, wherein the split printing control section is configured to determine whether there is data where dots are applied for a region that is surrounded by a plurality of pixels that line up in a main scanning direction and a sub-scanning direction in the region in the vicinity of the boundary.

5. The printing control apparatus according to claim 1, wherein the split printing control section is configured to determine that there is data where dots are applied when a number of pixels for which there is data where dots are applied is a predetermined value or more in the region in the vicinity of the boundary.

6. The printing control apparatus according to claim 1, wherein the split printing control section is configured to determine that there is data where dots are applied when there is data of a ruled line along the region in the vicinity of the boundary.

7. The printing control apparatus according to claim 1, wherein the split printing control section is configured to determine whether there is data where dots are applied for pixels in the region in the vicinity of the boundary by using filter calculation.

8. A printing control method for using a recording head where a plurality of nozzles are arranged in a row formation with a predetermined pitch, and for performing interlace printing on an outward path and a return path such that a resolution is equal to or more than a resolution that is based on the pitch when printing is performed due to supplying of ink being received from an ink cartridge and ink droplets being discharged from each of the nozzles, the method comprising:

when a region that is printable in one band is split into a plurality of regions according to a predetermined number of splits, and the interlace printing is carried out in each of split regions on the outward path and the return path, determining whether there is data where dots are applied in a region in a vicinity of a boundary of two of the split regions, which includes at least one of the two of the split regions that are adjacent to each other, based on printing data for each of the split regions, and carrying out printing by making the number of splits an odd number of times in a case where there is data where dots are applied.

* * * * *